US010699630B2

(12) United States Patent
Ha et al.

(10) Patent No.: US 10,699,630 B2
(45) Date of Patent: Jun. 30, 2020

(54) LED ELECTRONIC BULLETIN BOARD ENABLING HIGH-SPEED IMAGE CALIBRATION

(71) Applicant: KLD CO., LTD., Seongnam-si, Gyeonggi-do (KR)

(72) Inventors: Young-Jae Ha, Seoul (KR); Sung Jun Ha, Anyang-si (KR)

(73) Assignee: KLD CO., LTD., Seongnam-si, Gyeonggi-Do (KR)

( * ) Notice: Subject to any disclaimer, the term of this patent is extended or adjusted under 35 U.S.C. 154(b) by 0 days.

(21) Appl. No.: 16/095,545

(22) PCT Filed: Jun. 11, 2018

(86) PCT No.: PCT/KR2018/006598
§ 371 (c)(1),
(2) Date: Oct. 22, 2018

(87) PCT Pub. No.: WO2019/031698
PCT Pub. Date: Feb. 14, 2019

(65) Prior Publication Data

US 2020/0058248 A1 Feb. 20, 2020

(30) Foreign Application Priority Data

Aug. 10, 2017 (KR) ..... 10-2017-0101781

(51) Int. Cl.
*G09G 5/06* (2006.01)
*G09G 3/32* (2016.01)
(Continued)

(52) U.S. Cl.
CPC ..... *G09G 3/32* (2013.01); *G09F 9/33* (2013.01); *G09G 5/00* (2013.01); *G09G 2310/08* (2013.01); *G09G 2320/0233* (2013.01); *G09G 2320/0285* (2013.01); *G09G 2320/0646* (2013.01); *G09G 2320/0693* (2013.01); *G09G 2360/141* (2013.01); *G09G 2360/147* (2013.01); *G09G 2370/02* (2013.01); *G09G 2370/06* (2013.01);
(Continued)

(58) Field of Classification Search
CPC ..... G09G 3/32; G09G 3/3611; G09G 3/20; H04N 1/4015; H05B 33/0842
USPC ..... 315/151; 345/83, 589; 347/9
See application file for complete search history.

(56) References Cited

U.S. PATENT DOCUMENTS

2017/0316754 A1* 11/2017 Katougi ..... G09G 5/00

* cited by examiner

*Primary Examiner* — Abdul-Samad A Adediran
(74) *Attorney, Agent, or Firm* — Novick, Kim & Lee, PLLC; Jae Youn Kim

(57) ABSTRACT

Provided is an an LED electronic bulletin board enabling high-speed image calibration, which is configured to apply brightness calibration data in consideration of brightness characteristics according to a brightness value through determination of whether or not there is a difference in a brightness value of a pixel or a part of an expression portion of the LED electronic bulletin board, which is to be expressed, with respect to image information inputted through a pixel capacitor controller installed between an image input device and a main controller unit (MCU), and then calibrate the image data inputted in real-time to express brightness-calibrated image data on the LED electronic bulletin board so that the image brightness of the electronic bulletin board can be calibrated irrespective of a configuration of an electronic bulletin board expression driving circuit.

3 Claims, 5 Drawing Sheets

(51) Int. Cl.
*G09F 9/33* (2006.01)
*G09G 5/00* (2006.01)

(52) U.S. Cl.
CPC ..... *G09G 2370/16* (2013.01); *G09G 2380/06* (2013.01)

LED ELECTRONIC BULLETIN BOARD ENABLING HIGH-SPEED IMAGE CALIBRATION

TECHNICAL FIELD

The present invention relates to an LED electronic bulletin board enabling high-speed image calibration, and more particularly, to an LED electronic bulletin board enabling high-speed image calibration, which is configured to apply brightness calibration data in consideration of brightness characteristics according to a brightness value through determination of whether or not there is a difference in a brightness value of a pixel or a part of an expression portion of the LED electronic bulletin board, which is to be expressed, with respect to image information inputted through a pixel capacitor controller installed between an image input device and a main controller unit (MCU), and then calibrate the image data inputted in real-time to express brightness-calibrated image data on the LED electronic bulletin board so that the image brightness of the electronic bulletin board can be calibrated irrespective of a configuration of an electronic bulletin board expression driving circuit.

BACKGROUND ART

A light emitting diode (LED) is an optical semiconductor device that emits a light when voltage is applied. The LED is widely used in a variety of electronic products, electronic display boards such as instrument panels, and the like with various colors including red, green, blue, yellow, etc.

Among these, an LED electronic bulletin board is configured such that a number of LEDs are arranged in the form of a matrix thereon to form pixels so that an image can be displayed. Such an LED electronic bulletin board is installed and used in various forms on the exterior or interior of a building so as to deliver advertisements or various items of information.

Typically, the LED electronic bulletin board receives a video signal from an audio/video (AV) device such as a DVD player, a VCR player, broadcasting equipment, or the like, and converts the received video signal into an appropriate signal so that an image is displayed on the electronic bulletin board. A number of LEDs or small fluorescent tubes are arranged in the form of a matrix on the LED electronic bulletin board to display various items of information such as various kinds of characters or pictures.

The LED electronic bulletin board is a display device that implements a color image with excellent resolution and various colors, and is installed and used in various forms on the external wall or the interior of a building to deliver advertisement or broadcasting services to implement an image or a moving picture. The LED electronic bulletin board includes, as a basic constituent element, a unit pixel consisting of light emitting diodes (LEDs) that emit red (R), green (G), and blue (B) colors, and pixels are arranged in the form of a matrix of horizontal rows and vertical columns to constitute one LED panel or LED board.

The LED electronic bulletin board can supply data corresponding to each of points of an image to an associated one of the pixels to implement various colors through the control of the brightness of the LEDs of red, green and blue colors, and also implement an image with various colors over the LED electronic bulletin board. The resolution of a screen that can be implemented by the LED electronic bulletin board of a given area is determined by the number of pixels within a unit area. Thus, as the size of the pixel is decreased, the resolution of the LED electronic bulletin board can be increased. Nevertheless, there is a limitation in reducing the size of the pixel to a predetermined size due to a limitation of a manufacture process or technique.

In addition, as shown in FIGS. 1 and 2, a general electronic bulletin board is configured such that it is controlled by signals CLK and LATCH through the drive of a constant current driving LED via a main controller unit (MCU) and a sub controller unit (SCU), data read from a memory is stored in a shift register of an LED constant current driver IC, and image data is processed by a data input/output driving method of outputting the image data to a color-dependent LED according to each data when an OE (Output Enable) output control signal is asserted, In the meantime, a conventional electronic bulletin board is operated by a separate device and driving algorithm for brightness calibration according to each electronic bulletin board depending on the expression mode, the expression dot, and the entire size of the electronic bulletin board. The conventional electronic bulletin board is operated by a driving algorithm necessary separately depending on a module- and dot-dependent brightness calibration value of electronic bulletin boards, leading to a restriction in compatibility between the electronic bulletin boards, which results in unnecessary additional installation of a device.

Therefore, there is a proposal for a technology in which module- and dot-dependent brightness calibration of electronic bulletin boards is enabled, and the brightness of the LED electronic bulletin board can be conveniently calibrated irrespective of a pixel or brightness value of the LED electronic bulletin board.

DISCLOSURE OF INVENTION

Technical Problem

Accordingly, the present invention has been made to solve the above-mentioned problems occurring in the prior art, and it is an object of the present invention to provide an LED electronic bulletin board enabling high-speed image calibration, which is configured to apply brightness calibration data in consideration of brightness characteristics according to a brightness value through determination of whether or not there is a difference in a brightness value of a pixel or a part of an expression portion of the LED electronic bulletin board, which is to be expressed, with respect to image information inputted through a pixel capacitor controller installed between an image input device and a main controller unit (MCU), and then calibrate the image data inputted in real-time to express brightness-calibrated image data on the LED electronic bulletin board so that the image brightness of the electronic bulletin board can be calibrated irrespective of a configuration of an electronic bulletin board expression driving circuit.

Another object of the present invention is to provide an an LED electronic bulletin board enabling high-speed image calibration, which is configured to calibrate brightness calibration data created using a brightness calibration algorithm depending on a pixel- and dot-dependent brightness value of the electronic bulletin board with respect to image information inputted, and the image data inputted in real-time to create a brightness calibration data table, and synthesize an image data stream being inputted with the brightness calibration data in real-time to create brightness-calibrated data so that the created brightness-calibrated data can be expressed as an expression reference basic value and thus a driving algorithm having no change upon powering-ON/OFF of the electronic bulletin board can be separately operated independently, thereby enabling remote control of the LED electronic bulletin board irrespective of a configuration of the electronic bulletin board, leading to simplification of manipulation of the LED electronic bulletin board, and resulting in high-speed calculation and application of an accurate calibration value.

Technical Solution

To achieve the above objects, the present invention provides an LED electronic bulletin board enabling high-speed image calibration, including: an image input device configured to serve as an information source that supplies an image signal to be displayed on an LED electronic bulletin board, such as a device that plays a video medium of DVD, HDMI, DP or VCR, a video playback medium transmitted from a user terminal through a wireless network, or a computer that fetches image data stored in a memory and transmits the image data to the LED electronic bulletin board; a pixel capacitor controller installed between the image input device and a main controller unit (MCU), the pixel capacitor controller 100 being configured to measure each brightness of a pixel or an expression portion of the LED electronic bulletin board, which is to be expressed, using an image optical sensor or an optical measurement device with respect to image data transmitted through the image input device, measure a brightness value of each pixel constituting a unit area of the expression portion measured, create brightness calibration data using a brightness calibration algorithm depending on a brightness value of a brightness data table created with respect to image data inputted based on the brightness data table created to correspond each pixel coordinate, calibrate the created brightness calibration data and the image data inputted in real-time to create a brightness calibration data table, and synthesize an image data stream being inputted with the brightness calibration data in real-time through a brightness calibration logic of a brightness calibration controller to create brightness-calibrated data for application to an image input port of the main controller unit (MCU); an MCU configured to generate a driving current to drive each light source of an LED electronic bulletin board module in order to express image data calibrated and created through the synthesis with brightness calibration data by application of the brightness calibration data by the pixel capacitor controller depending on the brightness of a brightness value of a pixel or an expression portion of the LED electronic bulletin board with respect to an image signal transmitted from the image input device; an SCU configured to control a data clocking signal and a horizontal synchronizing signal for clocking and transmission of a brightness-calibrated pixel image applied thereto from the MCU, and generate a synchronizing signal so that the brightness-calibrated pixel image is expressed; and an LED electronic bulletin board including a unit expression module composed of a plurality of LEDs with n×m pixels arranged in the form of a matrix of n rows and m columns to form a screen, and configured to display image data created and applied by calibration of the brightness of the image data inputted through the real-time synthesis of the image data stream with brightness calibration data by application of the brightness calibration data by the pixel capacitor controller in consideration of the brightness of a brightness value of a pixel or an expression portion of the LED electronic bulletin board with respect to the image signal applied from the image input device.

In addition, the LED electronic bulletin board enabling high-speed image calibration of an embodiment of the present invention may further include a user terminal implemented as a wireless terminal for driving an application for remote control of the LED electronic bulletin board so that the user terminal has wireless access to the image input device that provides an image signal source through the WIFI network to either supply a brightness-calibrated image signal to the LED electronic bulletin board through the driving of the pixel capacitor controller, or perform a driving and control process of a brightness calibration algorithm depending on the brightness value of the brightness data table created to correspond each pixel coordinate with respect to a brightness value of each pixel measured in consideration of a unit area of the expression portion measured with respect to the brightness of an image of the expression portion of the LED electronic bulletin board, measured through the image optical sensor or the optical measurement device.

Advantageous Effects

The LED electronic bulletin board enabling high-speed image calibration according to an embodiment of the present invention as constructed above have the following advantageous effects.

The LED electronic bulletin board enabling high-speed image calibration applies brightness calibration data in consideration of brightness characteristics according to a brightness value through determination of whether or not there is a difference in a brightness value of a pixel or a part of an expression portion of the LED electronic bulletin board, which is to be expressed, with respect to image information inputted through a pixel capacitor controller installed between an image input device and a main controller unit (MCU), and then calibrates the image data inputted in real-time to express brightness-calibrated image data on the LED electronic bulletin board so that the image brightness of the electronic bulletin board can be calibrated irrespective of a configuration of an electronic bulletin board expression driving circuit.

In addition, the LED electronic bulletin board enabling high-speed image calibration according to an embodiment of the present invention provides an effect in that it is configured to calibrate brightness calibration data created using a brightness calibration algorithm depending on a pixel- and dot-dependent brightness value of the electronic bulletin board with respect to image information inputted, and the image data inputted in real-time to create a brightness calibration data table, and synthesize an image data stream being inputted with the brightness calibration data in real-time to create brightness-calibrated data so that the created brightness-calibrated data can be expressed as an expression reference basic value and thus a driving algorithm having no change upon powering-ON/OFF of the electronic bulletin board can be separately operated independently, thereby enabling remote control of the LED electronic bulletin board irrespective of a configuration of the electronic bulletin board, leading to simplification of manipulation of the LED electronic bulletin board, and resulting in high-speed calculation and application of an accurate calibration value.

Further, the LED electronic bulletin board enabling high-speed image calibration according to an embodiment of the present invention provides an effect in that the pixel capacitor controller is operated in cooperation with an conventional LED electronic bulletin board so that the image brightness of the electronic bulletin board can be easily calibrated although the inventive LED electronic bulletin board and electronic bulletin board expression driving circuit are different from electronic bulletin boards and electronic bulletin board expression driving circuits produced by other manufacturers, and the inventive LED electronic bulletin board can easily cope with an external environment, electrical properties, and other image noises, and thus an error of a change in threshold value is small, leading to a reduction in a calibration value and a facilitation of operation and manipulation by a hardware configuration.

Further, the LED electronic bulletin board enabling high-speed image calibration according to an embodiment of the present invention can be individually operated depending on a module- and dot-dependent brightness calibration value of electronic bulletin boards by a driving algorithm of a pixel capacitor controller for brightness calibration according to each electronic bulletin board depending on the expression mode, the expression dot, and the entire size of the electronic bulletin board, thereby facilitating compatibility between the electronic bulletin boards and thus eliminating the necessity for additional installation of a device according to replacement of the device, which results in resource saving and reduction in costs according to the device installation.

BRIEF DESCRIPTION OF THE DRAWINGS

The above and other objects, features and advantages of the present invention will be apparent from the following detailed description of the preferred embodiments of the invention in conjunction with the accompanying drawings, in which.

BEST MODE FOR CARRYING OUT THE INVENTION

Hereinafter, preferred embodiments of according to the present invention will be described in detail with reference to the accompanying drawings. In the following description of the present invention, a detailed description of related known functions and configurations incorporated herein will be omitted, if necessary, when it may rather make the subject matter of the present invention unclear.

In the present specification, in the case where any one constituent element "transmits" data or a signal to another constituent element, this means that the one constituent element may directly "transmit" the data or the signal to the other constituent element, or may "transmit" the data or the signal to the other constituent element through at least another constituent element.

Figure 1:
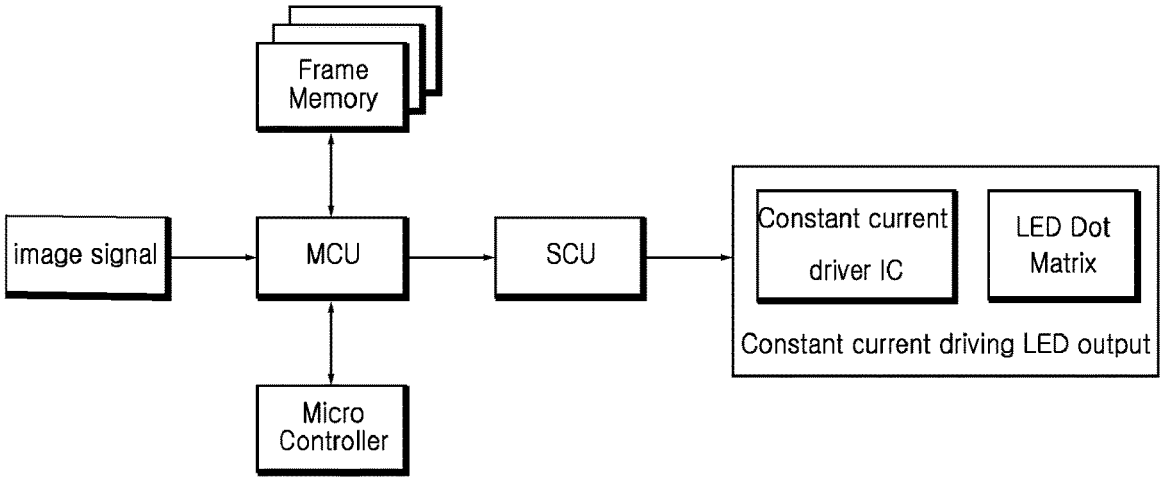
FIG. 1 PRIOR ART
FIG. 1 is a block diagram illustrating a configuration for a control procedure of a conventional LED electronic bulletin board according to the prior art.
Figure 2:
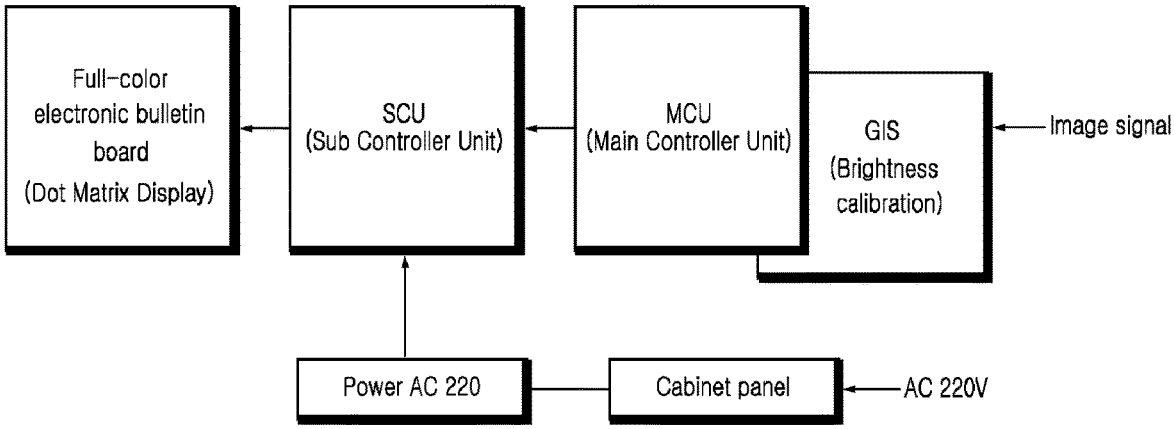
FIG. 2 PRIOR ART
FIG. 2 is a block diagram illustrating an internal configuration for the driving of an LED electronic bulletin board according to the prior art.
Figure 3:
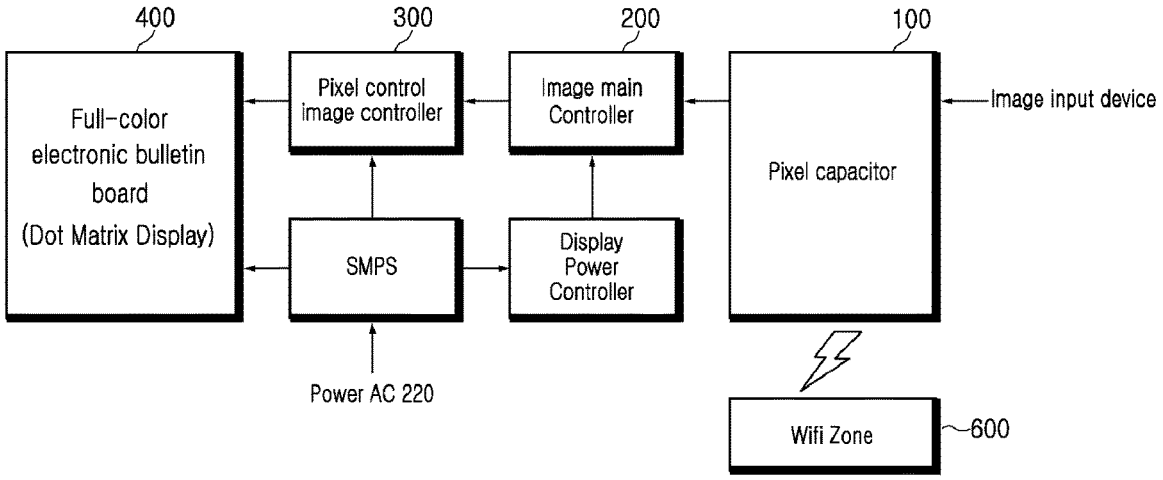
FIG. 3 is a block diagram illustrating a configuration of an LED electronic bulletin board enabling high-speed image calibration according to the present invention.
Figure 4:
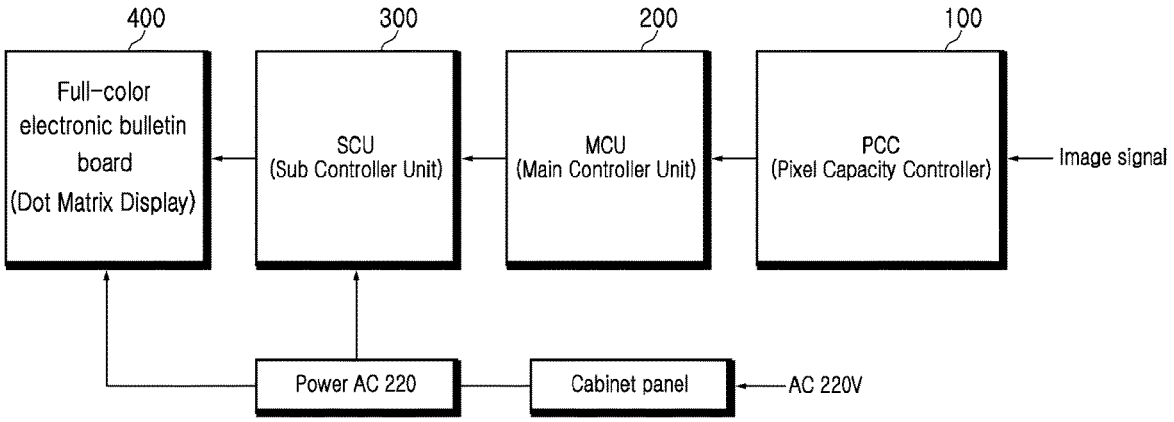
FIG. 4 is a block diagram illustrating an internal configuration for the driving of an LED electronic bulletin board enabling high-speed image calibration according to the present invention.

FIG. 3 is a block diagram illustrating a configuration of an LED electronic bulletin board enabling high-speed image calibration according to the present invention, and FIG. 4 is a block diagram illustrating an internal configuration for the driving of an LED electronic bulletin board enabling high-speed image calibration according to the present invention.

An LED electronic bulletin board enabling high-speed image calibration according to the present invention largely includes an image signal source, a pixel capacitor controller 100, an MCU 200, an SCU 300, an LED electronic bulletin board 400, a wireless network 600, and a user terminal 700.

Hereinafter, the detailed configuration of an LED electronic bulletin board enabling high-speed image calibration will be described with reference to FIGS. 3 and 4.

First, the image signal source, which is an information source that supplies an image signal to be displayed on the LED electronic bulletin board 400, may be either a device that plays a video medium of DVD, HDMI, DP or VCR, or a computer that fetches image data stored in a memory and transmits the image data to the LED electronic bulletin board 400, but is not limited thereto.

The pixel capacitor controller 100 is installed between an image input device 500 and a main controller unit (MCU) 200. The pixel capacitor controller 100 is configured to determine whether or not there is a difference in a brightness value of a pixel or a part of an expression portion of the LED electronic bulletin board, which is to be expressed, with respect to an image signal transmitted through an image input device to apply brightness calibration data, synthesize an image data steam with brightness calibration data in real-time to create brightness-calibrated data with respect to the image data being inputted to the pixel capacitor controller, and transmit the created data to an image input port the main controller unit (MCU).

In this case, the creation of the brightness-calibrated data is performed by measuring each brightness of the LED electronic bulletin board using an image optical sensor or an optical measurement device with respect to an image of the expression portion of the LED electronic bulletin board to measure a brightness value of each pixel constituting a unit area of the expression portion measured, and creating a brightness data table corresponding to each pixel coordinate. A brightness calibration data table is created using a brightness calibration algorithm depending on a brightness value of the created brightness data table.

More specifically, the pixel capacitor controller 100 is installed between the image input device 500 and the main controller unit (MCU) 200. The pixel capacitor controller 100 is configured to apply brightness calibration data created using a brightness calibration algorithm depending on a brightness value of the brightness data table created to correspond each pixel coordinate to a brightness value of each pixel constituting a unit area of the expression portion measured with respect to the brightness of an image of the expression portion of the LED electronic bulletin board, measured through the image optical sensor or the optical measurement device in consideration of brightness characteristics according to a brightness value of a pixel or a part of an expression portion of the LED electronic bulletin board, which is to be expressed, with respect to image data transmitted through the image input device 500, and then calibrate the image data inputted in real-time to display brightness-calibrated image data on the LED electronic bulletin board.

In other words, the pixel capacitor controller 100 is configured such that it calibrates brightness calibration data created using a brightness calibration algorithm depending on a brightness value of a brightness data table created with respect to image data transmitted through the image input device 500, and the image data inputted in real-time to create a brightness calibration data table, and synthesizes an image data stream being inputted with the brightness calibration data in real-time through a brightness calibration logic of a brightness calibration controller to create brightness-calibrated data for application to an image input port of the main controller unit (MCU).

The MCU 200 generates a driving current to drive each light source of an LED electronic bulletin board 400 module in order to express image data calibrated and created through the synthesis with brightness calibration data by application of the brightness calibration data by the pixel capacitor controller 100 depending on the brightness of a brightness value of a pixel or an expression portion of the LED electronic bulletin board with respect to an image signal transmitted from the image input device.

The SCU 300 controls a data clocking signal and a horizontal synchronizing signal for clocking and transmission of a brightness-calibrated pixel image applied thereto from the MCU 200, and generates a synchronizing signal for application to the LED electronic bulletin board 400 so that the brightness-calibrated pixel image is expressed.

The LED electronic bulletin board 400 includes a unit expression module composed of a plurality of LEDs with n×m pixels arranged in the form of a matrix of n rows and m columns to form a screen, and displays image data created and applied by calibration of the brightness of the image data inputted through the real-time synthesis of the image data stream with brightness calibration data by application of the brightness calibration data by the pixel capacitor controller 100 in consideration of the brightness of a brightness value of a pixel or an expression portion of the LED electronic bulletin board with respect to the image signal applied from the image input device.

In the meantime, the wireless network 600 serves as a WIFI network and is provided to be operated in cooperation with the image input device 500 that provides an image signal source and the user terminal 700 for wireless access to express an image on the LED electronic bulletin board 400.

The user terminal 700 is implemented as a wireless terminal for driving an application for remote control of the LED electronic bulletin board 400 according to the present invention so that the user terminal has wireless access to the image input device 500 that provides an image signal source through the WIFI network, and then supplies a brightness-calibrated image signal to the LED electronic bulletin board 400.

In addition, the user terminal 700 performs a driving and control process of a brightness calibration algorithm depending on the brightness value of the brightness data table created to correspond each pixel coordinate with respect to a brightness value of each pixel measured in consideration of a unit area of the expression portion measured with respect to the brightness of an image of the expression portion of the LED electronic bulletin board, measured through the image optical sensor or the optical measurement device to thereby remotely control the expression of the image on the LED electronic bulletin board 400.

Meanwhile, the user terminal 700 has an operating system (OS) for driving i-phones and android phones for the purpose of remote control, and may be controlled by executing an application (APP) necessary for the driving thereof.

Figure 5:
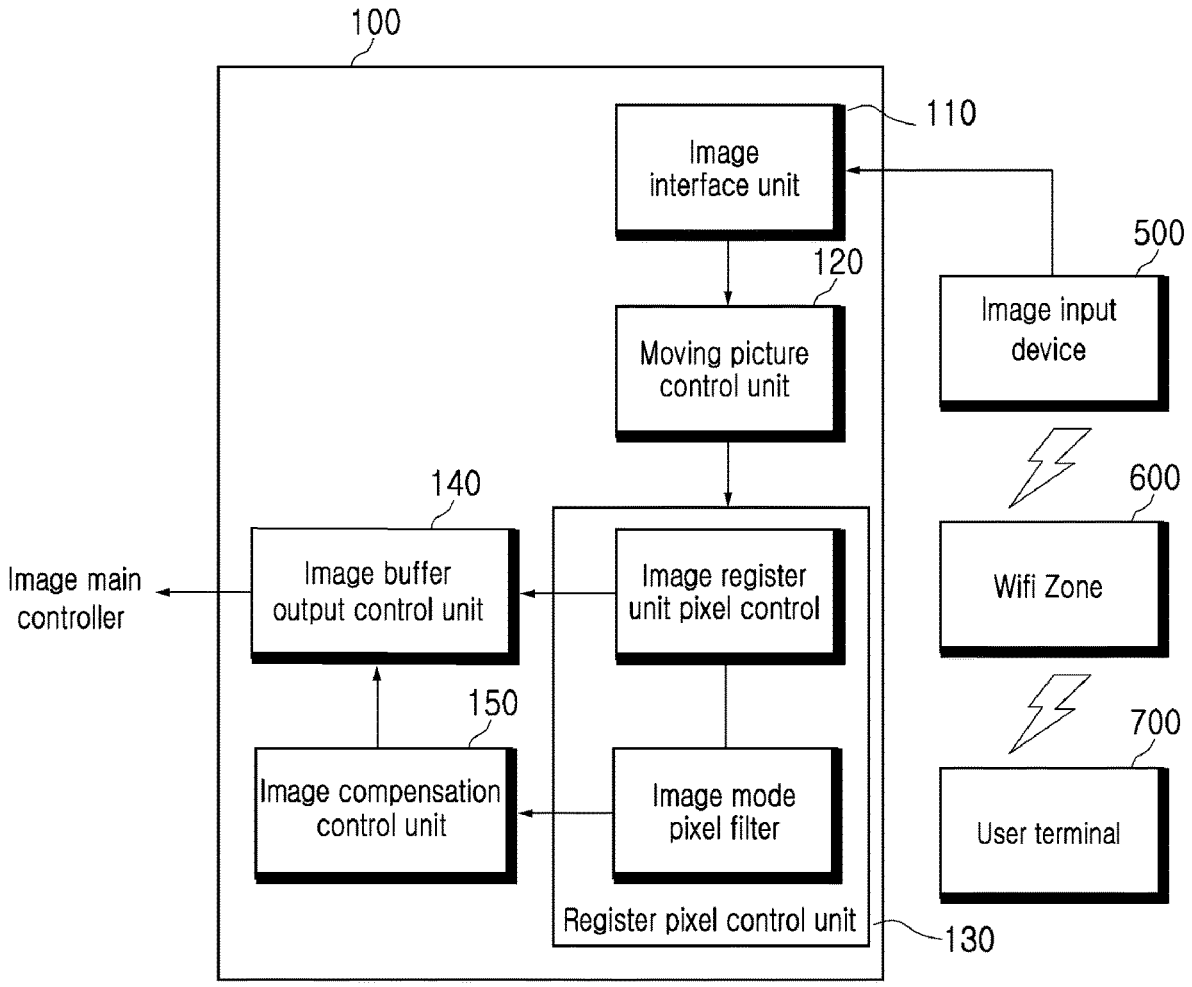
FIG. 5 is a block diagram illustrating an internal configuration of a pixel capacitor controller (PCC) of the LED electronic bulletin board enabling high-speed image calibration of FIG. 4.
Figure 6:
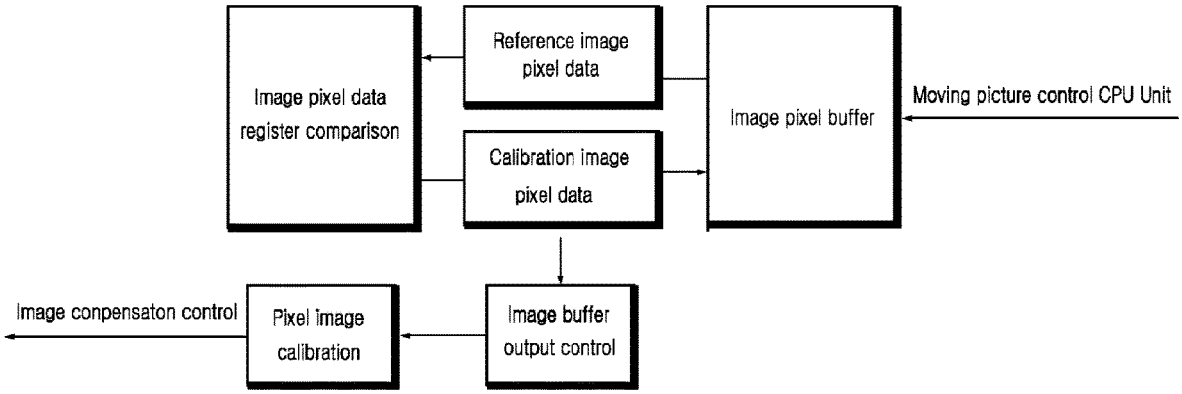
FIG. 6 is a block diagram illustrating a configuration for a control procedure of the pixel capacitor controller (PCC) of FIG. 5.

FIG. 5 is a block diagram illustrating an internal configuration of a pixel capacitor controller (PCC) of the LED electronic bulletin board enabling high-speed image calibration of FIG. 4 according to the present invention, and FIG. 6 is a block diagram illustrating a configuration for a control procedure of the pixel capacitor controller (PCC) of FIG. 5.

The detailed configuration and operation of the pixel capacitor controller (PCC) according to the present invention will be described hereinafter with reference to FIGS. 3 to 6.

First, an image data interface unit 110 receives an associated image signal transmitted through the image input device and transmits the received image signal to a moving picture control unit 120 which in turn performs a control process for the control of a register pixel. 130

A register pixel control unit 130 measures each brightness of a pixel or an expression portion of the LED electronic bulletin board 400, which is to be expressed, using an image optical sensor or an optical measurement device with respect to an image signal transmitted to the moving picture control unit 120, measures a brightness value of each pixel constituting a unit area of the expression portion measured, and create brightness calibration data using a brightness calibration algorithm depending on a brightness value of a brightness data table created with respect to image data inputted based on the brightness data table created to correspond each pixel coordinate.

Thereafter, the register pixel control unit 130 calibrates the created brightness calibration data and the image data inputted in real-time to create a brightness calibration data table, synthesizes an image data stream being inputted with the brightness calibration data in real-time through a brightness calibration logic of a brightness calibration controller to create brightness-calibrated data, and applies the calibrated image information to an image buffer output control unit 140.

Figure 7:
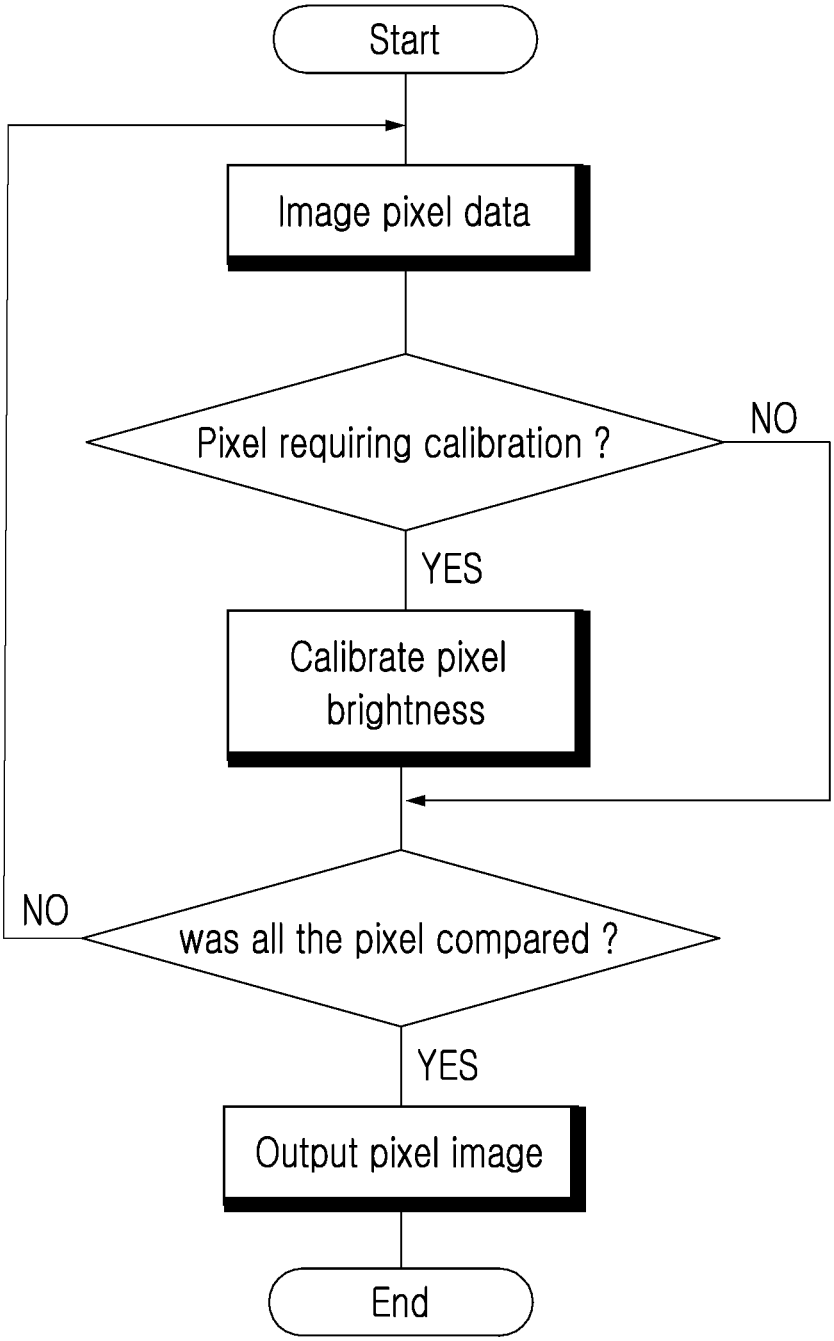
FIG. 7 is a flow chart illustrating a control operation of an LED electronic bulletin board enabling high-speed image calibration according to the present invention.

More specifically, as shown in a flow chart of FIG. 7 illustrating a control operation of an LED electronic bulletin board enabling high-speed image calibration, when an image signal transmitted through the image input device 500 is applied to a register pixel control unit 130 through a moving picture control unit 120, the register pixel control unit 130 measures each brightness of the LED electronic bulletin board using an image optical sensor or an optical measurement device with respect to an image of the expression portion of the LED electronic bulletin board to measure a brightness value of each pixel constituting a unit area of the expression portion measured, and creates a brightness data table corresponding to each pixel coordinate. In addition, the register pixel control unit 130 creates a brightness calibration data table using a brightness calibration algorithm depending on a brightness value of the created brightness data table.

In other words, the image data transmitted through the image input device 500 is configured such that the brightness calibration data table is created by calibrating the image data inputted in real-time and the brightness calibration data created by using the brightness calibration algorithm depending on the brightness value of the brightness data table, and the image data stream being inputted is synthesized with the brightness calibration data in real-time through a brightness calibration logic of a brightness calibration controller to create brightness-calibrated data for application to the image input port of the main controller unit (MCU).

The invention claimed is:

1. An LED electronic bulletin board enabling high-speed image calibration, comprising:

an image input device configured to serve as an information source that supplies an image signal to be displayed on the LED electronic bulletin board, the image input device including a device that plays a video medium of DVD, HDMI, DP or VCR, or plays a video playback medium transmitted from a user terminal through a wireless network, or a computer that fetches image data stored in a memory and transmits the image data to the LED electronic bulletin board;

a pixel capacitor controller installed between the image input device and a main controller unit (MCU), the pixel capacitor controller being configured to measure brightness of a pixel or an expression portion of the LED electronic bulletin board, which is to be expressed, using an image optical sensor or an optical measurement device with respect to image data transmitted through the image input device, measure a brightness value of each pixel constituting a unit area of the expression portion measured, create brightness calibration data using a brightness calibration algorithm depending on a brightness value of a brightness data table created with respect to image data inputted based on the brightness data table created to correspond to each pixel coordinate, calibrate the created brightness calibration data and the image data inputted in real-time to create a brightness calibration data table, and synthesize an image data stream being inputted with the brightness calibration data in real-time through a brightness calibration logic of a brightness calibration controller to create brightness-calibrated data for application to an image input port of the MCU;

the MCU configured to generate a driving current to drive each light source of an LED electronic bulletin board module in order to express image data calibrated and created through the real-time synthesis of the image data stream with the brightness calibration data by application of the brightness calibration data by the pixel capacitor controller depending on the brightness of the pixel or the expression portion of the LED electronic bulletin board with respect to the image signal transmitted from the image input device;

an SCU configured to control a data clocking signal and a horizontal synchronizing signal for clocking and transmission of a brightness-calibrated pixel image applied thereto from the MCU, and generate a synchronizing signal so that the brightness-calibrated pixel image is expressed; and the LED electronic bulletin board including a unit expression module composed of a plurality of LEDs with n×m pixels arranged in a matrix of n rows and m columns to form a screen, and configured to display the image data created and applied by the calibration of the brightness of the image data inputted through the real-time synthesis of the image data stream with the brightness calibration data by application of the brightness calibration data by the pixel capacitor controller in consideration of the brightness of the pixel or the expression portion of the LED electronic bulletin board with respect to the image signal applied from the image input device.

2. The LED electronic bulletin board enabling high-speed image calibration according to claim 1, further comprising a user terminal implemented as a wireless terminal for driving an application for remote control of the LED electronic bulletin board so that the user terminal has wireless access to the image input device that provides an image signal source through a WIFI network to either supply a brightness-calibrated image signal to the LED electronic bulletin board through driving of the pixel capacitor controller, or perform a driving and control process of the brightness calibration algorithm depending on the brightness value of the brightness data table created to correspond to each pixel coordinate with respect to the brightness value of each pixel measured in consideration of the unit area of the expression portion measured with respect to the brightness of an image of the expression portion of the LED electronic bulletin board, measured through the image optical sensor or the optical measurement device.

3. The LED electronic bulletin board enabling high-speed image calibration according to claim 1, wherein the pixel capacitor controller is installed between the image input device and the MCU, the pixel capacitor controller being configured to apply the brightness calibration data created using the brightness calibration algorithm depending on the brightness value of the brightness data table created to correspond to each pixel coordinate to the brightness value of each pixel constituting the unit area of the expression portion measured with respect to the brightness measured in consideration of brightness characteristics according to the brightness value through determination of whether or not there is a difference in the brightness value of the pixel or a part of the expression portion of the LED electronic bulletin board, which is to be expressed, with respect to the image data transmitted through the image input device, and then calibrate the image data inputted in real-time to display the brightness-calibrated image data on the LED electronic bulletin board.

* * * * *